US010632395B1

(12) United States Patent
Davis

(10) Patent No.: US 10,632,395 B1
(45) Date of Patent: Apr. 28, 2020

(54) MOBILE ELECTRONIC TRACK START SYSTEM

(71) Applicant: Donnell A. Davis, Bowie, MD (US)

(72) Inventor: Donnell A. Davis, Bowie, MD (US)

( * ) Notice: Subject to any disclaimer, the term of this patent is extended or adjusted under 35 U.S.C. 154(b) by 28 days.

(21) Appl. No.: 14/923,371

(22) Filed: Oct. 26, 2015

Related U.S. Application Data

(60) Provisional application No. 62/041,914, filed on Aug. 26, 2014.

(51) Int. Cl.
*A63K 3/02* (2006.01)

(52) U.S. Cl.
CPC ..... *A63K 3/02* (2013.01)

(58) Field of Classification Search
CPC ..... A63K 3/02
See application file for complete search history.

(56) References Cited

U.S. PATENT DOCUMENTS 8,083,646 B2 * 12/2011 Chapa, Jr. ..... A63B 24/0006 482/1
2005/0117018 A1 * 6/2005 Wolf ..... H04N 5/23206 348/143
2007/0244667 A1 * 10/2007 Ligotti, III ..... A63B 24/0003 702/182
2007/0298853 A1 * 12/2007 Yu ..... A63K 3/02 463/6
2011/0060537 A1 * 3/2011 Moodie ..... A61B 5/1036 702/41
2015/0051720 A1 * 2/2015 Genteman ..... A61F 5/00 700/91
2016/0114238 A1 * 4/2016 Santino, Jr. ..... G08B 5/38 340/4.13

* cited by examiner

*Primary Examiner* — James S. McClellan
*Assistant Examiner* — Peter J Iannuzzi
(74) *Attorney, Agent, or Firm* — Terry M. Sanks, Esq.; Beusse Wolter Sanks & Maire, PLLC

(57) ABSTRACT

A track start system including a detection subsystem to detect a false start of an individual participating in a racing event and to acquire biomechanical data from the individual to produce performance metrics readable by a user regarding the individual wherein detection of the false start is detectable independent of a starting block that may be used by the individual. Another system is also disclosed.

20 Claims, 7 Drawing Sheets

MOBILE ELECTRONIC TRACK START SYSTEM

CROSS-REFERENCE TO RELATED APPLICATIONS

This application claims the benefit of U.S. Provisional Patent Application No. 62/041,914 filed Aug. 26, 2014, and incorporated herein by reference in its entirety.

BACKGROUND

Embodiments generally relates to electronic signaling and recording, and more particularly to a system, method, and computer program product for issuing a start prompt for sporting competitions and recording aspects of such a competition for present or later analytical purposes.

In recent years, there has been an increase in the rise in popularity of two fields: personal fitness and smartphone use. For illustrative purposes, according to a study, about 91 percent of American adults own a cell phone, and more than half of all U.S. mobile devices are smartphones. As more and more people get involved in these areas, they are becoming more and more integrated with one another. This can be evidenced by the substantial development of the sports and athletic activity device tracker industry, which focuses on human kinetics. Such devices include "smart equipment" and "player analysis technology." The study of human kinetics, or kinesiology, involves analyzing the movement, performance, and function of the human body by applying the science of biomechanics. Kinesiology is applied in areas of health and fitness for all levels of athletes, but most often focuses on the aspects of training elite athletes.

The growing integration of personal fitness and smartphone use has culminated in the use of fitness-based smartphone software applications, or "apps." Various apps have achieved significant utility in the area of competitive sports. For example, there exists at least one app that is useful for recording athlete performances, and then providing an interface for analyzing the images of the performances and making marks thereon.

One particular sport wherein the precise tracking and analyzation of human body movements is important is track and field. Specifically, with regard to running events, individuals known as "starters" rely on their own visual perception and/or expensive detection equipment to determine whether a start is "fair." A fair start is one in which a runner moves at a time that is permitted by the rules to start, often incorporating a signal to identify such time. The signal often consists of a gunshot, horn, whistle, siren, or similar audio alert of sufficient intensity, depending on the nature of the competition. Conversely, a "false start" is a movement by a runner before (or in some cases after) being signaled or otherwise permitted by the rules to start.

A problem with currently used start signals and apparatus's associated therewith is that they are often very expensive to use. Additionally, especially with non-championship level track meets, a start signal may not be emitted with precision if it is not synched to a starting countdown sequence. Furthermore, as in the case when a gunshot is used, younger participants and audience members may be unnecessarily frightened.

For championship-level track meets, a false start apparatus is used to assist starters in determining when a false start has occurred. Products approved for such use must conform to guidelines established by the International Association of Athletics Federation (IAAF), which state that "the starting blocks shall be linked to an IAAF approved start apparatus. The Starter and/or an assigned Recaller shall wear headphones in order to clearly hear the acoustic signal emitted when the apparatus detects a false start (i.e. when reaction time is less than 100/1000 ths of a second). As soon as the Starter and/or the assigned Recaller hears the acoustic signal, and if the gun is fired, or the approved apparatus is activated, there shall be a recall and the Starter shall immediately examine the reaction times on the false start apparatus in order to confirm which athlete(s) is/are responsible for the false start." Products that meet these requirements are typically expensive and rather complex in set-up and use. Furthermore, it is often the case that these are not the same products that get used for other non-championship meets, if any products are used at all.

For training purposes, the chance to use such products is even further remote. Considering that many racing events, especially those which use starter blocks, are not simply won or lost based on which runner is the fastest, but running technique may also be a key factor in winning or losing.

While simpler false start systems do exist that may be used for non-championship meets, such as starting blocks that incorporate "contact pads", as well as electronic pistols and bullhorn starters, such products still often place a relatively significant financial burden on those seeking to use them and/or lack certain desirable features, such as the athlete performance feedback described above. When no false start apparatus is used at all, biases and conflicting starter opinions may cause false starts to be misjudged. These situations can be very demoralizing for athletes who work very hard to prepare for competitions.

Given the foregoing, event promoters, operators, organizers, participants and spectators of such track events, particularly of non-championship caliber events, would benefit from having athlete kinetics acquired and analyzed in a simplified and cost-effective way, such as on a smartphone or another mobile device. Such an acquisition would also be beneficial to participants and their coaches during training in advance of such events. Systems, methods, and computer program products that provide a cost-effective way of emitting a start signal that is synched with a start sequence are also desire where the start signal may or may not consist a starter pistol.

SUMMARY

This Summary is provided to introduce a selection of concepts. These concepts are further described below in the Detailed Description section. This Summary is not intended to identify key features or essential features of this disclosure's subject matter, nor is this Summary intended as an aid in determining the scope of the disclosed subject matter.

A track start system is disclosed comprising a detection subsystem to detect a false start of an individual participating in a racing event and to acquire biomechanical data from the individual to produce performance metrics readable by a user regarding the individual wherein detection of the false start is detectable independent of a starting block that may be used by the individual.

In another embodiment, a system is disclosed comprising a computing device, and a start race device in communication with a computing device, the computing device and start race device are located at a location were initiation of a race event occurs. The system further comprises a strobe sensor device located behind an individual about to start the race event independent of a starting block. In combination the start race device and strobe sensor device detects a false start to the race event by the individual independent of a sensor as part of a starting block. The strobe sensor acquires biomechanical data of the individual, the biomechanical data is wirelessly communicated to the computing device to provide performance metrics to a user of the computing device.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
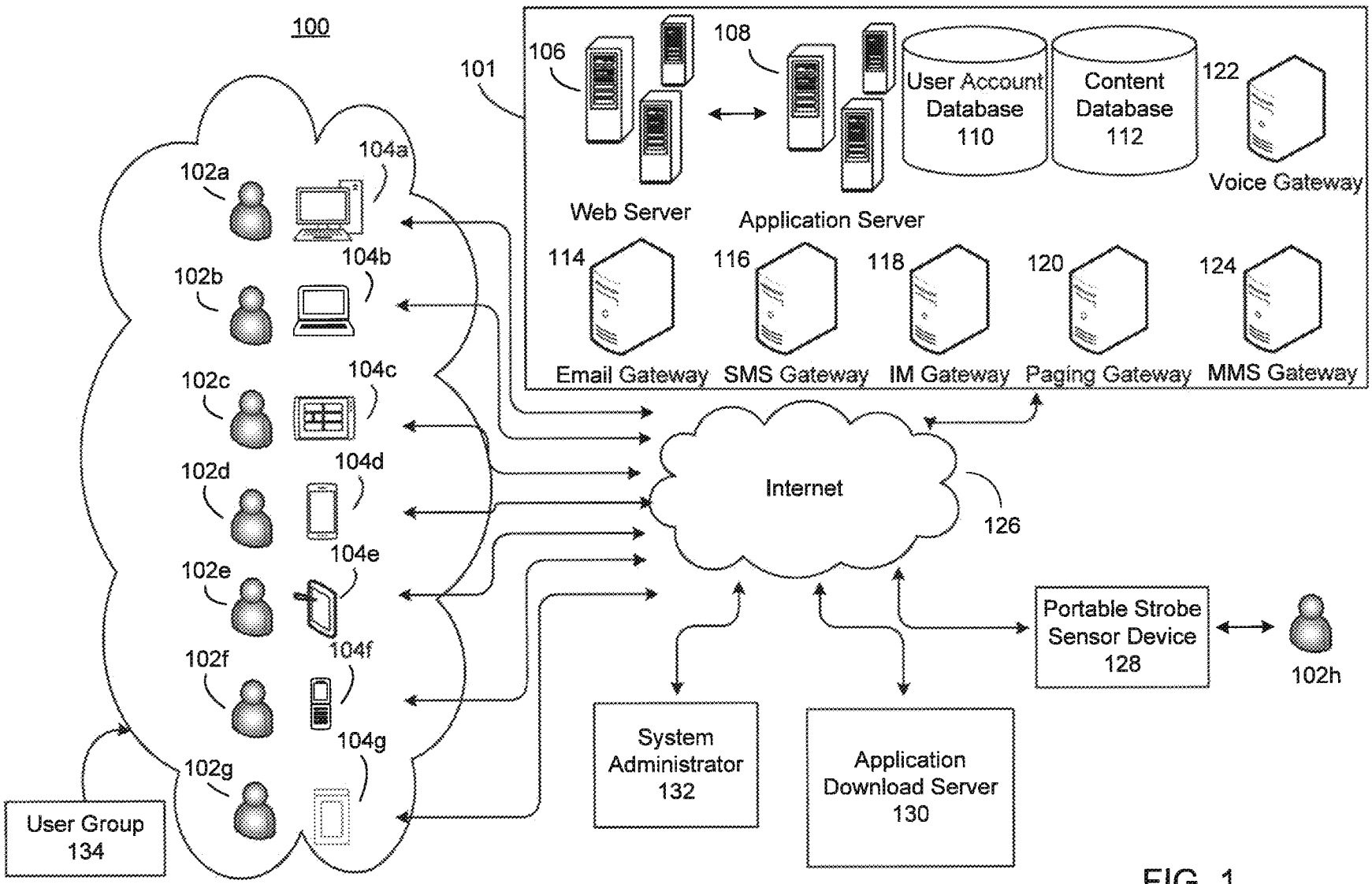
FIG. 1 is a block diagram of an embodiment of a system for facilitating the reception, recording, and displaying of human movements and providing an electronic start signal for such movements.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Embodiments are directed to a system, method, and computer program product which facilitate the receiving, recording, and displaying of human movement, particularly for an athlete, in a simple and cost-effective way, along with a means to signal a starting time for such athlete. Specifically, a system, method, and computer program product is disclosed wherein an athlete's movement may be initiated by an audio or visual start signal synched with a start sequence. Furthermore, an athlete's movement may be detected relative to the start signal in order to determine if the athlete moved before or after the signal was given. Furthermore, a system, method, and computer program product are disclosed that may record athlete movements and display them later for analytical purposes. This may be accomplished without a need for using a starter pistol as a starting signal.

The term "user" and/or the plural form of this term are used herein to refer to individuals who may use the disclosed system, method, or computer program product such as coaches, trainers, athletes, and the like.

The term "athlete" and/or the plural form of this term are used herein to refer to an individual who may engage in exercise and fitness activities, competitive and non-competitive sporting activities, and the like. An athlete may also be a user.

Referring now to FIG. 1, a block diagram of an embodiment of a system for facilitating the reception, recording, and displaying of human movements and providing an electronic start signal for such movements is shown. A cloud-based, Internet-enabled device communication system 100 is provided which may include a plurality of users 102 (shown as users 102*a-g* in FIG. 1) accessing—via a user computing device 104 (shown as respective computing devices 106*a-g* in FIG. 1) and a network 126, such as the global, public Internet—an application service provider's cloud-based, Internet-enabled infrastructure 101. A user application may be downloaded onto the user computing device 104, such as but not limited to, from an application download server 130. The application download server 130 may be a public application store service or a private download service or link. The user computing device 104 may access the application download server 130 via the network 126. In an embodiment, the infrastructure 101 may be accessed via a website or web application.

Multiple users 102 may, simultaneously or at different times, access (via, for example, a user application) infrastructure 101 in order to engage in communication with portable strobe sensor device 128 or to access user account database 110 or content database 112. In an embodiment, the user 102*h* may use a portable strobe sensor device 128 to communicate with one or more user(s) 102 via one or more user computing device(s) 104 or to upload content to a content database 112. Such content may comprise athlete movements that are captured by the portable strobe sensor device 128. Such communication may comprise voice transmissions from the user 102*h*. The portable strobe sensor device 128 may comprise a touchscreen or keypad interface by which the user 102*h* may enter textual communications to be sent to one or more user computing device(s) 104. Additionally, the portable strobe sensor device 128 may further comprise a display screen for viewing textual communications sent from one or more user computing device(s) 104.

The user 102 may access the infrastructure 101 in order to access and/or store content from/in the user account database 110 and/or the content database 112. Specifically, the user 102 may access the infrastructure 101 in order to, among other things, upload or download athlete performance data, input or edit user credentials, and/or share athlete performance data with other users 102.

In an embodiment, the user computing device 104 may be configured as a desktop computer 104*a*, a laptop computer 104*b*, a tablet or mobile computer 104*c*, a smartphone (alternatively referred to as a mobile device) 104*d*, a Personal Digital Assistant (PDA) 104*e*, a mobile phone 104*f*, a handheld scanner 104*g*, any commercially-available intelligent communications device, a wearable device (such as, but not limited to ones worn on a wrist, head mountable display, etc.), or the like. Such computing devices may comprise sensors such as, but not limited to, a camera, a CCD, near-field communications transceiver, Bluetooth® chip (a wireless technology standard standardized as IEEE 802.15.1), a GPS sensor, and the like. Such sensors may be configured to detect, but not limited to, environmental elements, physical assets, and the like.

An application service provider's cloud-based, communications infrastructure 101 may include one or more web servers 106, one or more application servers 108, user account database 110, content database 112, an email gateway 114, an SMS gateway 116, an Instant Message (IM) gateway 118, a paging gateway 120, a voice gateway 122, and an MMS gateway 124. In an embodiment, the application servers 108 contain computational instructions, or code, that enables the functionality of the system 100. In an embodiment, the user account database 110 and/or the content database 112 are not contained within the infrastructure 101. As a non-limiting example, one or both of these databases may be supplied by a third-party.

The user account database 110 contains account information for each user 102 within user group 134 of system 100, including but not limited to log in credentials; user location information; type of computing device used; user account settings and preferences; records of content uploaded, accessed, shared; infrastructure 101 usage; and the like. In an embodiment, user account database 110 may further contain payment/billing information for each user 102 within user group 134 of system 100.

Content database 112 contains content uploaded from one or more users 102 within user group 134 of system 100. Such content may comprise images of athlete movements as captured by portable strobe sensor device 128. The content may further comprise audio commentary on the movements and/or visual markings portrayed on the images of such movements. The images of the movements may be in the form of recorded video available for playback or in the form of still photograph images available for viewing.

In an embodiment, a system administrator 132 may access infrastructure 101 via internet 126 in order to oversee and manage infrastructure 101. In another embodiment, user account database 110 and content database 112 may comprise one or more data stores within (or remotely located from) infrastructure 101 or be a memory included in (or coupled to) web server 110.

User account database 110 and content database 112 may be physically separate from one another, logically separate, or physically or logically indistinguishable from each other.

As will be appreciated by those skilled in the relevant art(s) after reading the description herein, in such an embodiment, an application service provider—an individual person, business, or other entity—may allow access, on a free registration, paid subscriber and/or pay-per-use basis, to infrastructure 101 via one or more World-Wide Web (WWW) sites on the Internet 126. Thus, system 100 is scalable.

As will also be appreciated by those skilled in the relevant art(s), in an embodiment, various screens would be generated by server 106 in response to input from users 102 over Internet 126. That is, in such an embodiment, server 106 is a typical web server running a server application at a website which sends out webpages in response to Hypertext Transfer Protocol (HTTP) or Hypertext Transfer Protocol Secured (HTTPS) requests from remote browsers on various computing devices 104 being used by various users 102. Thus, server 106 is able to provide a graphical user interface (GUI) to users 102 of system 100 in the form of webpages. These webpages are sent to the user's PC, laptop, mobile device, PDA or like device 104, and would result in the GUI being displayed.

As will be appreciated by those skilled in the relevant art(s) after reading the description herein, an embodiment may include providing a tool for facilitating content sharing coupled with a producer-designated physical asset to devices 104 as a stand-alone system (e.g., installed on one server PC) or as an enterprise system wherein all the components of infrastructure 100 are connected and communicate via an inter-corporate Wide Area Network (WAN) or Local Area Network (LAN). As a non-limiting example, in an embodiment where users 102 are all personnel/employees of the same company, the present disclosure may be implemented as a stand-alone system, rather than as a web service (i.e., Application Service Provider (ASP) model utilized by various unassociated/unaffiliated users) as shown in FIG. 1.

As will also be appreciated by those skilled in the relevant art(s) after reading the description herein, an embodiment may include providing the tools for facilitating content sharing coupled with a producer-designated physical asset via infrastructure 101 and devices 104 via a browser or operating system pre-installed with an application or a browser or operating system with a separately downloaded application on such devices 104. That is, as will also be apparent to one skilled in the relevant art(s) after reading the description herein, the application that facilitates the content sharing platform herein, may be part of the "standard" browser or operating system that ships with computing device 104 or may be later added to an existing browser or operating system as part of an "add-on," "plug-in," or "app store download."

Figure 2:
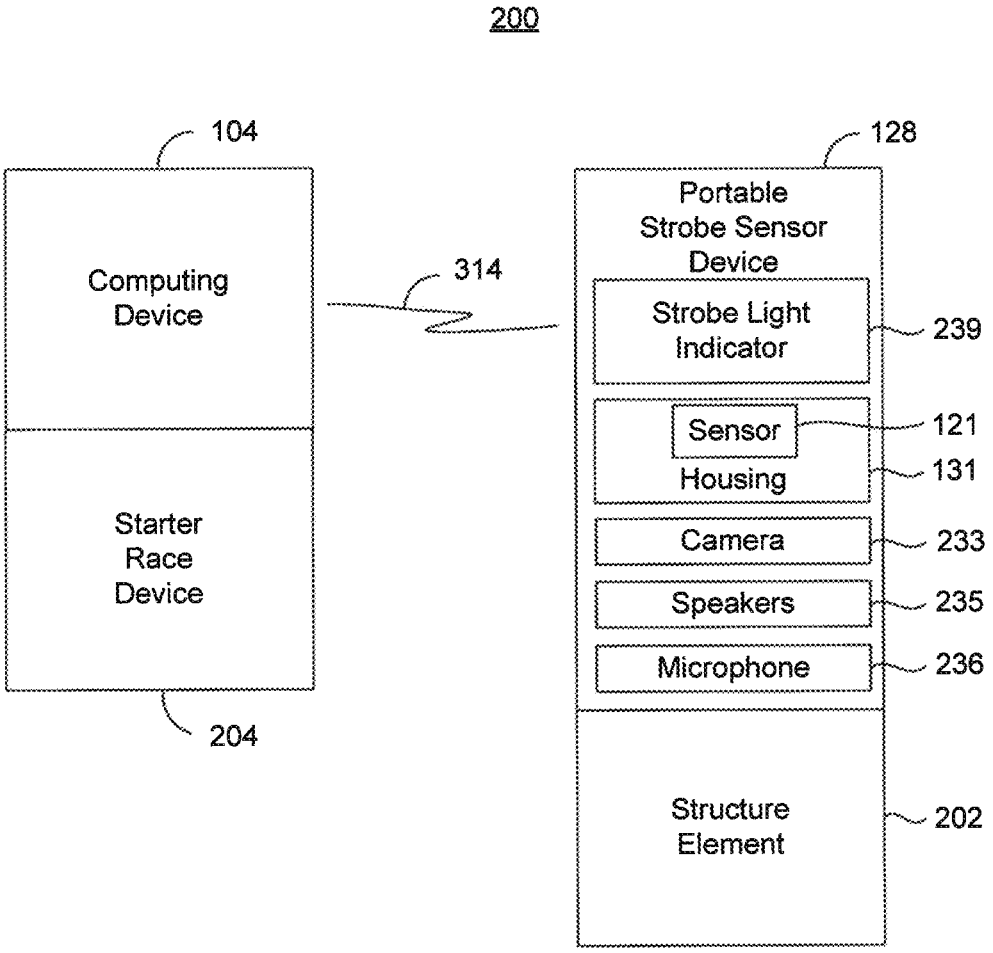
FIG. 2 is an image illustrating an embodiment of a configuration of a mobile electronic track start system with false start identification capabilities.

Referring now to FIG. 2, an image illustrating an exemplary configuration of a mobile electronic track start system with false start identification capabilities 200 is shown. The system 200 may comprise user computing device 104, structure equipment 202, portable strobe sensor device 128 or detection subsystem, and start race device 204. The user computing device 104 comprises a software application, or app, which serves to provide the functionality of system 200.

In an embodiment, the user computing device 104 may be configured with an attachable start race device 204. The start race device 204 may comprise any one of a plethora of available amplified speakers 302 (not shown in FIG. 2) and/or light flash devices 304 (not shown in FIG. 2) that are currently known in the art or will be known in the future. Such devices 204 may attach directly to the user computing device 104 or may be communicatively coupled to the computing device 104 via wireless connectivity 314 (not shown in FIG. 2) provided by radio-frequency identification (RFID), Bluetooth®, Wi-Fi, and other similar means as will be appreciated by those skilled in the relevant art(s) after reading the description herein. The wireless connectivity 314 may enable system 200 to operate within a range from long waves to ultra-high frequency such as Gigahertz (GHz). The RFID capability is an especially important component of the system 200 in that it links each individual portable strobe sensor device 128 to specific associated teams, athletes, coaches, etc. This is useful for situations in which multiple portable strobe sensor devices 128 are used simultaneously in the same race.

The structure equipment 202 may comprise retractable traffic cones 308 (not shown in FIG. 2). The cones 308 may fold down to less than 40 mm height for easy storage and transportation. Additionally, the cones 308 may comprise materials as recognized by those skilled in the relevant art(s) as being weatherproof and resistant to damage and wear. By way of example and not limitation, the cones 308 may comprise rigid polymers. In another embodiment, the structure equipment 202 may comprises other objects as will be appreciated by those skilled in the relevant art(s) after reading the description herein.

The structure equipment 202 may be used for mounting the portable strobe sensor device 128 thereto via strap-on, clip-on, or similar means as recognized by those skilled in the relevant art(s). The strobe sensor device 128 may be portable and may be attached to any appropriate structure equipment 202 or may be positioned on a flat surface. The strobe sensor device 128 may comprise one or more embedded passive infrared (PIR) sensor(s) 129 or similar technology as recognized by those skilled in the relevant art(s), a camera 233, one or more speaker(s) 235/microphone(s) 236, and a strobe light indicator 239. Other similar sensors may include, but are not limited to, microwave sensors, another light spectrum sensor, and/or Bluetooth® technology based sensors. Though PIR sensor is used throughout, it is not limited in view of the fact that other sensor technology may be used. Therefore as used herein, PIR sensors is used as an embodiment whereas other sensor technology is also application and is not limited, or excluded, by the use of PIR sensors herein.

The PIR sensors 121 may be linked and synchronized by the app on the user computing device 104 and may be embedded within the portable strobe sensor device 128 and/or positioned strategically on various other units of structure equipment 202 or elsewhere as will be appreciated by those skilled in the relevant art(s) after reading the description herein such as to be able to distinctly identity lane and false start infractions, such infractions being understood by those skilled in the relevant art(s). The PIR sensors 121 comprise electronic sensors that measure infrared (IR) light that radiates from objects in their field of view. The PIR sensors 121 do not detect motion, but rather abrupt changes in temperature (to signify a human body has moved within a given area) at a given point by monitoring the point's IR radiation level. Thus, the sensor 121 may be used to capture motion but not necessarily an image. The PIR sensors 121 configured for use with system 200 may have reversible orientation mirrors which allow a very narrow "curtain" coverage, are highly-sensitive, and have calibratable sensor features. Thus curtain technology may be used to further focus, zoom in or direct the sensor 121 to the athlete, so as not to pick up extraneous movement not associated with the athlete. For example, if the racing event begins on a bend in a track, movement from an athlete in another lane will not be detected. As a non-limiting example, the area of detection may be within less than one and up to about three meters.

The PIR sensors 121 may additionally comprise "Differential Detection" which prevents the sensors from registering false indications of change in instances wherein they are exposed to brief flashes of light or field-wide illumination. In an embodiment, each PIR sensor 121 may be mounted on a printed circuit board that contains the necessary electronics needed to interpret the signals from the sensor itself. The complete PIR sensor assembly may be contained within a housing 131, such as, by way of example and not limitation, an outer shell comprising a rigid polymer or similar material as will be appreciated by those skilled in the relevant art(s) after reading the description herein. Though illustrated in FIG. 2 as simply housing the sensor 121, in other non-limiting embodiments the housing may comprise all components disclosed herein within the portable strobe sensor device 128. The housing 131 may further comprise a transparent window through which infrared energy and/or visible light may enter. The window may comprise plastic, glass, a combination thereof, or other similar material as will be appreciated by those skilled in the relevant art(s) after reading the description herein. In an embodiment, the PIR sensors may be replaced by or used in conjunction with one or more microwave sensor(s), dual and/or combo sensor technology, or similar technology as will be appreciated by those skilled in the relevant art(s) after reading the description herein.

The camera 233, or imaging device, of the portable strobe sensor device 128 may use automatic wide-range angle lens technology to record video and capture snapshot photos. In an embodiment, other cameras may be associated with the device 128 and/or system 200 via wireless connectivity 314, shown in FIG. 3. Such additional cameras may be positioned at various other locations in order to provide various point-of-view options for system 200 and thereby achieve optimal angle analysis. The camera(s) allow the strobe sensor device 128 to acquire biomechanical data and transmit the data to the user computing device 104, thereby allowing users 102 to view performance metrics in real-time and/or store data to be reviewed later with the aid of a data analysis feature incorporated into the app within computing device 104. In an embodiment the use of the term biomechanical data and performance metrics may be interchangeable as this data and metrics are specific to information acquired about the athlete's performance while in the starting block and immediately after leaving the starting block.

Such data may be used for further training of an athlete as data is captured of the athlete from various other angles. As a non-limiting example, a user can be position at the ending location of a race. Using an embodiment disclosed herein, the user can capture data of the athlete from a backside of the athlete to ascertain if the athlete's form is proper when leaving the starting blocks, an aspect of the athlete's form (biomechanical data which may correspond to performance metrics) that is not readily identifiable from the front view that the user may have during the race. Thus when the athlete is participating in a sprinting event, during a "drive phase" of the event, such as, but not limited through about the first five meters to ten meters, using an embodiment disclosed herein the user may look at mechanics of the athlete during this phase of the event where a single coach can now view mechanics from at least two views.

The speaker(s) 235/microphone(s) 236 embedded in the portable strobe sensor device 128 may facilitate(s) two-way communication within system 200. By way of example and not limitation, the speaker(s) 235 may be used to provide an additional audio indication of a start signal for a given competition. The microphone(s) 236 may be used with the speaker(s) 235 to enable communication between the strobe sensor device 128 and the computing device 104, such as when the athlete needs to talk to a coach or other user during the moments right before a competition begins.

The strobe light indicator 239, or strobe sensor device, within the portable strobe sensor device 128 may be configured to display a bright light, such as a strobe light or similar device comprising intense illuminative capabilities as recognized by those skilled in the relevant art(s). Such a light may be displayed by the strobe sensor device 128 when it senses a "false start" by one or more athlete(s) via the embedded PIR sensors. A "false start" is a movement by an athlete before (or in some cases after) being signaled or otherwise permitted by the rules to start.

The strobe light indicator 239 may be solar-powered to facilitate efficiency and ease of use. In another embodiment, the strobe light indicator 239 may be powered by batteries, AC power, DC power, or any other means as recognized by those skilled in the relevant art(s). In another non-limiting embodiment, a sound may be used in place of the strobe light. Furthermore, other forms of light may also be used. Therefore, for sensing a false start, the embodiments disclosed herein are not limited to a strobe light.

Figure 3:
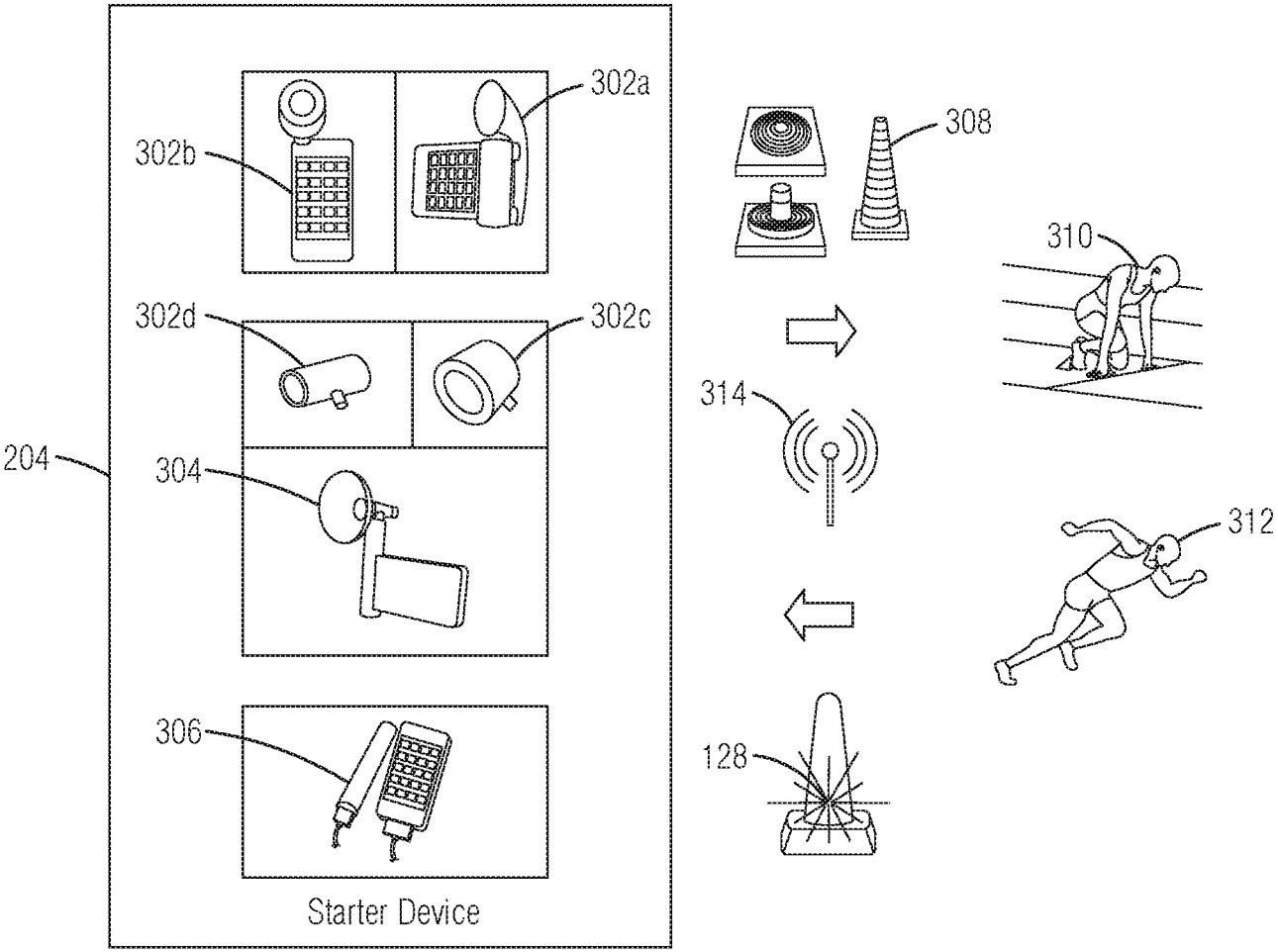
FIG. 3 is a dataflow diagram illustrating how information may be transferred within an embodiment of a configuration of a mobile electronic track start system with false start identification capabilities, with exemplary products useful therewith.

Referring now to FIG. 3, a dataflow diagram illustrating how information may be transferred within an exemplary configuration of a mobile electronic track start system with false start identification capabilities, with exemplary products useful therewith is shown. The main components that comprise the system 200 and facilitate the use thereof. Specifically, these components comprise the speaker 302*a-d*, a light flash device 304, a portable charging device 306, a structure 202, such as, but not limited to, a retractable traffic cone 308, a prepared athlete 310, an engaged athlete 312, the wireless connectivity 314, and the portable strobe sensor device 128.

The speaker 302 may be one of a few various known embodiments, shown as 302*a-d* to function as the start race device 204 within the system 200. The speakers 302 such as, but not limited to, the speaker 302*a* may attach to a connection at the base of the user computing device 104, such as, but not limited to, the smartphone shown in FIG. 3. In an embodiment, the speakers such as 302*b-d* may attach to the computing device 104 via a 3.55 mm interface that is well known to those skilled in the relevant art(s). In an embodiment, the start race device 204 may comprise wireless speakers. In an embodiment, a speaker used as the start race device 204 comprises power amplifier capabilities to produce a sound-level output that is rated comparable to the starting devices that meet International Association of Athletics Federation (IAAF) guidelines, which state that "[a]ll races shall be started with the firing of a closed-barrel pistol (starter's pistol) or gunless device which provides smoke or a flash visible to the timers. A misfire does not indicate a start. When a pistol is used as a starting device, .32 caliber (153.5 dB) is recommended for outdoor venues and a .22 caliber (130 dB) is recommended for indoor venues."

The light flash device 304 is capable of displaying a bright white flash of light, or similar visual indication as recognized by those skilled in the relevant art(s) as being clearly visible by starters and timers as a signal to start a competitive event, such as a race. In an embodiment, the light flash device 304 may comprise a device as shown in FIG. 3 that is attachable to the user computing device 104 and comprises a high-intensity light bulb or similar object recognized by those skilled in the relevant art(s) as being capable of producing a relatively high luminous flux, housed within a parabolic or hemispherical frame. Alternative embodiments may be available for the light flash device 304 as may become apparent to those skilled in the relevant art(s) after reading the description herein. In an embodiment, the light flash device 304 may be used in conjunction with the speaker 235, 302 to provide a visual and auditory start signal. The use of the speaker 235, 302 and/or the light flash device 304 may eliminate a need for a gunshot, replicated by a starter pistol, as a start signal, which may frighten some younger athletes, users, or spectators.

The portable charging device 306 may comprise any known portable charging device currently known in the art(s) or that will be known in the future. By way of example and not limitation, the portable charging device 306 may be a portable USB charger, as shown in FIG. 3. The portable charging device 306 may be used to keep the user computing device 104 powered on such as to prevent any loss of function from system 200 during its desired period of use.

The retractable traffic cone 308 may be useful for mounting the portable strobe sensor device 128 or other components of the system 200. The cone 308 may be height-adjustable to make it easier to position an attached the portable strobe sensor device 128 at various elevations for when an athlete is in a standing, crouching, or at other positions of varying height.

In an embodiment, as indicated by the top arrow in FIG. 3, data may flow from the user computing device 104, configured in various forms and with various components as shown in elements 302*a-d*, 304 and 306, as well as in additional forms and with other components as will be appreciated by those skilled in the relevant art(s) after reading the description herein, to the prepared athlete 310. The prepared athlete 310 may be awaiting a start signal. The start signal may be in the form of an auditory or visual cue emitted from the start race device 204. In an embodiment, the prepared runner 310 may also receive audio communication from user computing device 104 via wireless connectivity 314 sending such communication to be emitted from one or more speaker(s) 235 integrated with portable strobe sensor device 128. Wireless connectivity 314 may comprise Bluetooth®, Wi-Fi, and other similar connectivity means as recognized by those skilled in the relevant art(s). Prepared athlete 310 may also send audio communication to user computing device 104 using a microphone within portable strobe sensor device 128 via wireless connectivity 314. In an embodiment, portable strobe sensor device 128 may include a keypad and/or touchscreen interface as well as a display screen for facilitating textual communication between portable strobe sensor device 128 and user computing device 104.

Figure 4:
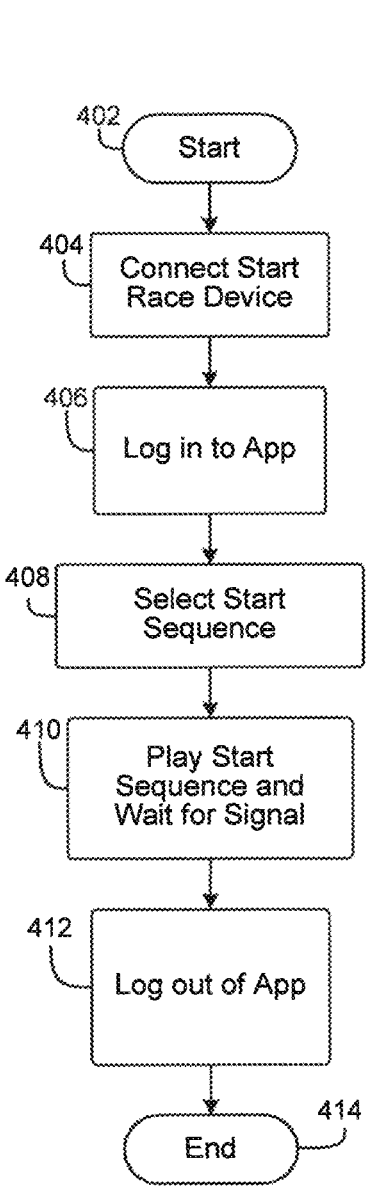
FIG. 4 is a flowchart illustrating an embodiment of a process for starting an athletic competition using a mobile electronic track start system with false start identification capabilities.

Similarly, as indicated by the bottom arrow in FIG. 4, data may flow from engaged athlete 312 to user computing device 104 via wireless connectivity 314. Specifically, PIR sensors as well as one or more camera(s) associated with portable strobe sensor device 128 may capture and send images of engaged athlete 312 to portable strobe sensor device 128, which in turn transmits the images to user computing device 104 for real-time viewing and/or for later review and analysis. Additionally, PIR sensors and/or one or more camera(s) associated with portable strobe sensor device 128 may detect when an athlete as made a "false start" and transmit such notification and images thereof to user computing device 104. Further indication of a false start may be provided to users 102 via the illumination of the strobe light indicator of strobe sensor device 128 or from a double start signal being emitted from start race device 204. Strobe sensor device 128 may be mounted on cone 308.

Referring now FIG. 4, a flowchart illustrating an exemplary process 400 for starting an athletic competition using a mobile electronic track start system with false start identification capabilities 200 is shown. The process 400, which may execute within portions of system 100, begins at step 402 with control passing immediately to step 404. At step 404, start race device 204 is connected to user computing device 104. The connection may be physical or may be established via a communicative coupling over wireless connectivity 314. At step 406, user 102 logs in to the app stored on user computing device 104. The log in may be accomplished by selecting the app on computing device 104 and entering a username, user ID, passcode, number combination, fingerprint scan, or any similar means as recognized by those skilled in the relevant art(s) as being able to gain authorized access to a software application. At step 408, user selects a start sequence on the app to be played by one or more speaker(s) attached to or associated with user computing device 104. By way of example and not limitation, various start sequences may comprise numbers ("3, 2, 1"), words ("on your mark, get set, go!"), or a combination thereof ("3, 2, 1, go!"). The start sequence is automatic once it has been initiated. The start sequence is adjustable and can be programmed to be randomized.

At step 410, the selected start sequence is played. The start sequence is synchronized with a start signal that is to be emitted by the start race device 204 after the start sequence is finished. In an embodiment wherein the start race device 204 is the speaker 302, the start alert may comprise an auditory format, such as a buzzer, siren, horn, or similar sound as recognized by those skilled in the relevant art(s). In an embodiment wherein the start race device is the light flash device 304, the start alert may comprise a visual format, such as a bright white light or similar display as recognized by those skilled in the relevant art(s). At step 412, the user 102 logs out of and closes the App. In an embodiment, the user 102 closes the app without logging out. The process 400 is terminated by step 414.

Figure 5:
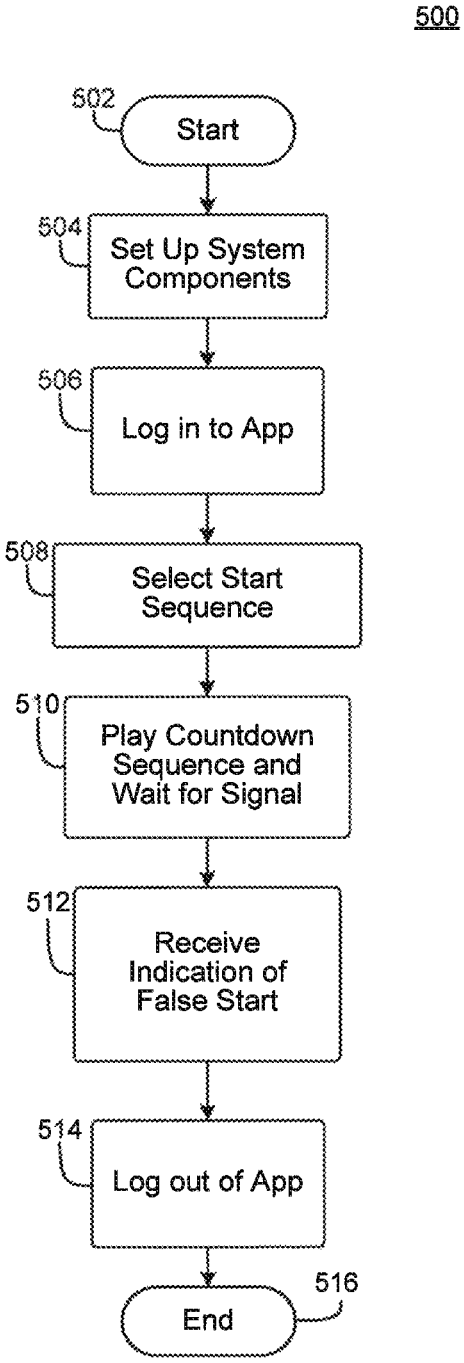
FIG. 5 is a flowchart illustrating an embodiment of a process for identifying a false start for an athletic event using a mobile electronic track start system with false start identification capabilities.

Referring now to FIG. 5, a flowchart illustrating an exemplary process 500 for identifying a false start for an athletic event using a mobile electronic track start system with false start identification capabilities 200 is shown. The process 500, which may execute within portions of system 100, beings at step 502 with control passing immediately to step 504. At step 504, the components of the system 200 are set up and prepared for use. This may involve connecting the start race device 204 to the user computing device 104, either physically or wirelessly. Additionally, the portable strobe sensor device 128 is positioned, powered on, and connected wirelessly via wireless connectivity 314 to the user computing device 104. Furthermore, any additional cameras and/or PIR sensors to be used may be positioned at their desired locations and connected wirelessly to the strobe sensor device 128 and/or the user computing device 104. At step 506, the user 102 logs in to the app on the user computing device 104 in the same way as in step 406 of process 400. At step 508, the user 102 selects a start sequence in the same way as in step 408 of process 400.

At step 510, the start sequence plays and a start signal is emitted in the same way as in step 410 of process 400. Additionally, the start sequence is configured to simultaneously initiate the PIR sensors of system 200 such that they become activated and are ready to capture a false start of one or more athlete(s) at the same time the start signal is emitted from race start device 204. At step 512, one or more user(s) 102 receives an indication that a false start has occurred. Such an indication is initiated by portable strobe sensor device 128, which may detect a false start via one or more camera(s) or PIR sensor(s) integrated therewith. Upon detection, the strobe sensor device 128 sends a notification via the wireless connectivity 314 to the user computing device 104 that a false start has occurred. Such a notification may comprise, by way of example and not limitation, a message that reads, "False Start." Additionally, the strobe sensor device 128 may send recorded the camera or IR images to the computing device 104 that the user 102 may view to confirm that a false start did indeed occur and to identify which athlete(s) committed the infraction. In another embodiment, the strobe sensor device 128 may illuminate a strobe light indicator or similar display device as will be appreciated by those skilled in the relevant art(s) after reading the description herein that signals to one or more user(s) 102 and athletes that a false start occurred. In an embodiment, athletes may be "recalled" back to the starting position after a false start has been detected, such as, by way of example and not limitation, emitting a double starting signal. At step 514, the user 102 logs out of and closes the App. In another embodiment, the user 102 closes the app without logging out. The process 500 is terminated by step 516.

Figure 6:
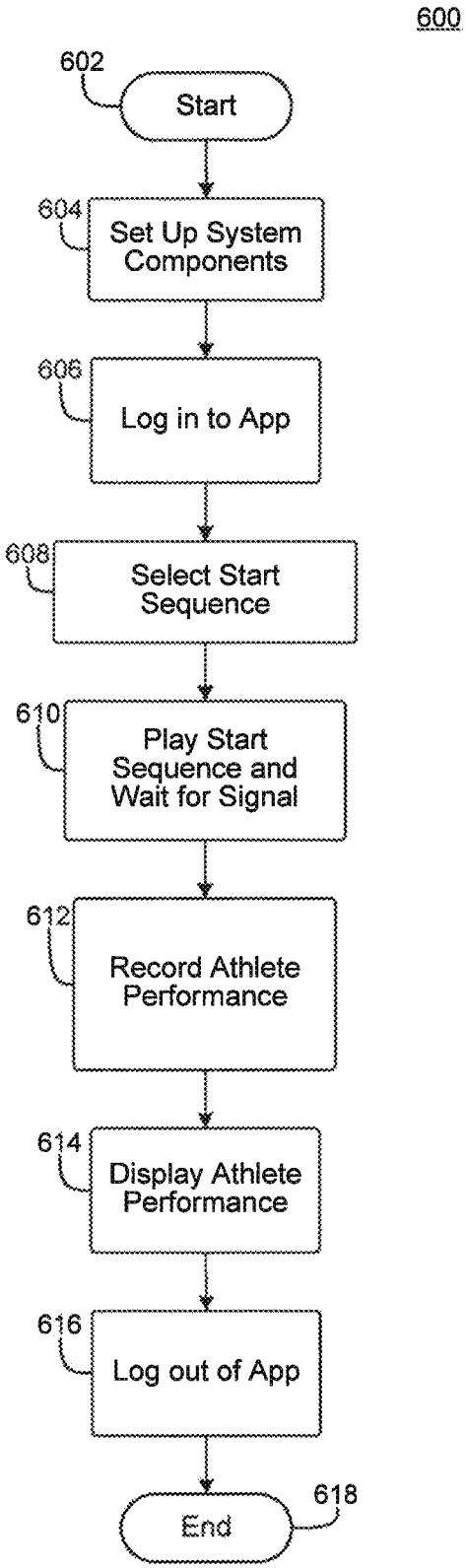
FIG. 6 is a flowchart illustrating an embodiment of a process for reviewing athlete performance using a mobile electronic track start system with false start identification capabilities.

Referring now to FIG. 6, is a flowchart illustrating an embodiment of a process 600 for reviewing athlete performance using a mobile electronic track start system with false start identification capabilities 200 is shown. The process 600, portions of which may execute within system 100, begins at step 602 with control passing immediately to step 604. At step 604, the components of the system 200 are set up and prepared for use in the same was as in step 504 of process 500. At step 606, the user 102 logs in to the app on the user computing device 104 in the same way as in step 406 of process 400. At step 608, the user 102 selects a start sequence in the same way as in step 408 of process 400. At step 610, the start sequence is played until a start sequence is emitted in the same was as in step 410 of process 400.

At step 612, athlete performance is recorded. This is accomplished by one or more camera(s) and one or more PIR sensor(s) associated with and integrated into system 200. The PIR sensors and cameras record still and/or moving images of one or more athlete(s) that are in their view, based on the strategic placement of the sensors and cameras. The images captured thereby are sent via wireless connectivity 314 or by direct physical connection, such as via USB or similar connection means, to portable strobe sensor device 128. The portable strobe sensor device 128 may then transmit the images via the wireless connectivity 314 or direct physical connection to user computer device 104 and/or content database 112. The content database 112 may further comprise one or more data acquisition module(s) that may receive image data from a microprocessor, memory, or similar device within the user computing device 104, and/or directly from the app. The data may then be transferred to a different computing device 104 via a USB connection, the wireless connectivity 314, or similar data transfer means as recognized by those skilled in the relevant art(s). At step 614, athlete performance is displayed. Specifically, images sent to the computing device 104 may either be displayed in real time or sent to the content database 112 to be viewed later. The user 102 may share images from the computing device 104 or the content database 112 with others by either sending them as an email, SMS message, MMS message, IM, or other similar means as recognized by those skilled in the relevant art(s). Additionally, the user 102 may grant permission to other users 102 to access their images stored in the content database 112. The app on the computing device 104 may allow the user 102 to input and attach audio commentary and/or visual markings to one or more captured image(s) so as to provide constructive critique to athletes in order to facilitate a learning experience that may help athletes achieve their maximum performance level.

In an embodiment, the user computing devices 104 include computer-readable instructions that may display biomechanical data from the images in a variety of user-friendly formats, such as charts, graphs, and the like. The data may be further analyzed to help track an athlete's performance and discover ways to maximize that performance. At step 616, the user 102 logs out of and closes the app on the user computing device 104. In an embodiment, the user 102 closes the app without logging out. The process 600 is terminated by step 618.

As is evident, the embodiments herein are based on the sensors 121 detecting the runner or athlete. More specifically, detection of the false start is not based on pressure being applied to starting blocks. Detection sensitivity by the passive sensor 121 may change for each phase of a start sequence, usually a three step start sequence ("on your mark," "get set," and "go"). Detection sensitivity of the sensors may increase with the advance of each start sequence. Furthermore, there may be a training sequence in which the sensor sensitivity may be manually set for an intended training purpose.

As is evident, the camera and speakers may be used to interact with athlete, especially during a training session. Thus, instead of a user, or coach having to remain at either the race starting location or race ending location, the user is able to remain at a location remote from the race starting location and utilize the speakers and microphone to reinforce training techniques while still away from the race starting location. Other features disclosed above may be omitted when in a training mode, more specifically not when an official race is occurring.

Figure 7:
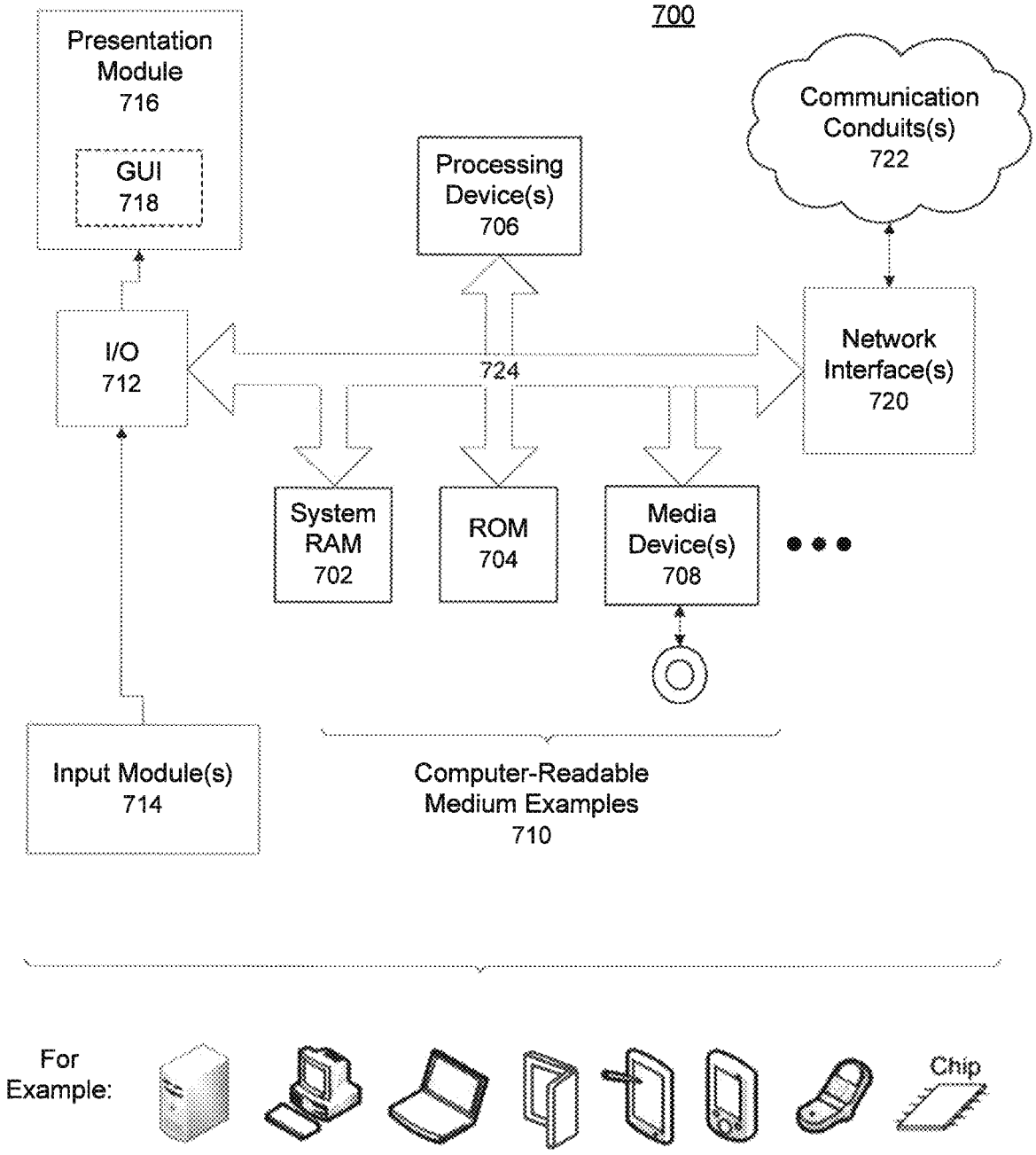
FIG. 7 is a block diagram of an embodiment of a computing system useful for implementing an aspect of an embodiment shown.

Referring now to FIG. 7, a block diagram of an embodiment of a computer system 700 useful for implementing an embodiment of the processes disclosed herein is shown. That is, FIG. 7 sets forth illustrative computing functionality 700 that may be used to implement the web server 106, one or more gateways 114-124, the content database 112, the user account database 110, the computing devices 104 utilized by user(s) 102 to access the Internet 126, or any other component of system 100. In all cases, computing functionality 700 represents one or more physical and tangible processing mechanisms.

Computing functionality 700 may comprise volatile and non-volatile memory, such as RAM 702 and ROM 704, as well as one or more processing devices 706 (e.g., one or more central processing units (CPUs), one or more graphical processing units (GPUs), and the like). Computing functionality 700 also optionally comprises various media devices 708, such as a hard disk module, an optical disk module, and so forth. Computing functionality 700 may perform various operations identified above when the processing device(s) 706 execute(s) instructions that are maintained by memory (e.g., RAM 702, ROM 704, and the like).

More generally, instructions and other information may be stored on any computer readable medium 710, including, but not limited to, static memory storage devices, magnetic storage devices, and optical storage devices. The term "computer readable medium" also encompasses plural storage devices. In all cases, the computer readable medium 710 represents some form of physical and tangible entity. By way of example, and not limitation, computer readable medium 710 may comprise "computer storage media" and "communications media."

"Computer storage media" comprises volatile and non-volatile, removable and non-removable media implemented in any method or technology for storage of information, such as computer readable instructions, data structures, program modules, or other data. Computer storage media may be, for example, and not limitation, RAM 702, ROM 704, EEPROM, Flash memory, or other memory technology, CD-ROM, digital versatile disks (DVD), or other optical storage, magnetic cassettes, magnetic tape, magnetic disk storage, or other magnetic storage devices, or any other medium which can be used to store the desired information and which can be accessed by a computer.

"Communication media" typically comprise computer readable instructions, data structures, program modules, or other data in a modulated data signal, such as carrier wave or other transport mechanism. Communication media may also comprise any information delivery media. The term "modulated data signal" means a signal that has one or more of its characteristics set or changed in such a manner as to encode information in the signal. By way of example, and not limitation, communication media comprises wired media such as a wired network or direct-wired connection, and wireless media such as acoustic, RF, infrared, and other wireless media. Combinations of any of the above are also included within the scope of computer readable medium.

Computing functionality 700 may also comprise an input/output module 712 for receiving various inputs (via input modules 714), and for providing various outputs (via one or more output modules). One particular output module mechanism may be a presentation module 716 and an associated GUI 718. Computing functionality 700 may also include one or more network interfaces 720 for exchanging data with other devices via one or more communication conduits 722. In some embodiments, one or more communication buses 724 communicatively couple the above-described components together.

The communication conduit(s) 722 may be implemented in any manner (e.g., by a local area network, a wide area network (e.g., the Internet), and the like, or any combination thereof). The communication conduit(s) 722 may include any combination of hardwired links, wireless links, routers, gateway functionality, name servers, and the like, governed by any protocol or combination of protocols.

Alternatively, or in addition, any of the functions described herein may be performed, at least in part, by one or more hardware logic components. For example, without limitation, illustrative types of hardware logic components that may be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), and the like.

The terms "module" and "component" as used herein generally represent software, firmware, hardware, or combinations thereof. In the case of a software implementation, the module or component represents program code that performs specified tasks when executed on a processor. The program code may be stored in one or more computer readable memory devices. The features of the present disclosure described herein are platform-independent, meaning that the techniques can be implemented on a variety of commercial computing platforms having a variety of processors (e.g., set-top box, desktop, laptop, notebook, tablet computer, personal digital assistant (PDA), mobile telephone, smart telephone, gaming console, and the like).

Thus, embodiments meet the above-identified needs by providing systems, methods, and computer program products which facilitate the receiving, recording, and displaying of human movement, particularly for athletes, in a simple and cost-effective way, along with a means to signal a starting time for such athletes. Specifically, systems, methods, and computer program products are disclosed wherein an athlete's movement may be initiated by an audio or visual start signal synched with a start sequence. Furthermore, an athlete's movement is detected relative to the start signal in order to determine if the athlete moved before or after the signal was given. Furthermore, systems, methods, and computer program products are disclosed that may record athlete movements and display them later for analytical purposes. All embodiments may be accomplished without the need for a gunshot, replicated with a starter pistol, as a starting signal.

In an embodiment, the receiving, recording, and displaying functions may be performed by a software application, or "app", configured for use with a smartphone or other computing device. The app may serve as the command center for an associated start race device and, in an embodiment, a portable strobe sensor device. The app on the smartphone may communicate with the various associated devices via wireless connectivity.

The wireless connectivity for the system may be accomplished by a wireless transceiver that enables and facilitates wireless functions such as Radio-frequency identification (RFID), Bluetooth®, and Wi-Fi connectivity in order to send and receive data to and from other existing media/devices. The RFID capability is an especially important component of the disclosed system in that it links each individual portable strobe sensor device to specific associated teams, athletes, coaches, etc. This is useful for situations in which multiple portable strobe sensor devices are used simultaneously in the same race.

The start race device may be directly integrated with a smartphone and physically connected thereto. In an embodiment, the start race device is a screen display capable of producing a substantially bright white flash or similar visual cue that is synchronized with the electronic start activation sequence of the app to provide a start signal that is clearly visible by the timers and competitors of an event. In an embodiment, the start race device comprises a speaker. The speaker may be wirelessly connected to the smartphone or may be of a size and configuration that allows it to clip on to the smartphone by using a 3.5 mm interface with power amplifier capabilities. Similar to the screen display, the speaker may be synchronized with the electronic start activation sequence of the app to provide a start signal that is easily heard by the timers and competitors of an event. In another embodiment, the screen display and the speaker may be used in conjunction with each other in order to provide both visual and audio cues for signaling the start of an event.

The portable strobe sensor device may comprise one or more embedded passive infrared (PIR) sensor(s), or similar technology, such as, but not limited to microwave, operating at another light frequency or Bluetooth® technology, a camera, a speaker/microphone, and wireless communication components that correspond with the wireless connectivity described above. In an embodiment, the PIR sensors may be replaced by or used in conjunction with one or more microwave sensor(s), dual and/or combo sensor technology, or similar technology as will be appreciated by those skilled in the relevant art(s) after reading the description herein. In an embodiment, the portable strobe sensor device may be configured to be integrated with adjustable-height traffic cones or similar structures with strobe light indicators. In an embodiment, the portable strobe sensor device may function on any flat surface, or may be attached to various forms of structural equipment by strap- or clip-on designs. In yet another embodiment, additional PIR sensors may be placed within structures positioned strategically along a track to provide optimal capturing of athlete movement for tracking purposes. The PIR sensors may also be configured to provide distinctive lane infraction identification. The additional PIR sensors may be linked to and synchronized by the app.

The camera used in the portable strobe sensor device is important for facilitating a "photo-start analysis" performed by the app. A main camera is contained within the portable strobe sensor device and may use automatic wide-range angle lens technology to record videos and take snapshot photographs. Additional cameras may be integrated with the device using wireless connectivity, such as Bluetooth®, Wi-Fi, and the like. These other cameras may be configured to provide a variety of point-of-view angles in order to provide optimal angle analysis. The portable strobe sensor device may utilize all of the information it takes in from the cameras in order to acquire biomechanical data for one or more athlete(s) and transmit it to a smartphone or other similar computing device, thereby allowing athletes and/or coaches to view performance metrics in real-time. The biomechanical data may also be stored for later viewing, which allows for the incorporation of a software-based data analysis feature that may be used to unlock an athlete's greater achievements for improving performance.

The speaker/microphone integrated with the portable strobe sensor device has two-way communication functionality, and mainly serves to give athletes an additional start signal that is synchronized with the app's automated start sequence process. In an embodiment, the speaker/microphone may allow communication to take place between the portable strobe sensor device and the smartphone housing the app.

Furthermore, while most prior art technology is connected to starting blocks, the embodiments disclosed herein is not attached to the starting blocks. This results in a cost savings as high tech starting blocks are not required if an embodiment disclosed herein is used.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

What I claim is:

1. A track start system comprising a detection subsystem including a false start indicator and at least one sensor to detect a false start of an individual participating in a racing event, during an initiated start sequence, and to acquire biomechanical data specific to a form from a backside of the individual at a start of the racing event during the start sequence to produce performance metrics of the individual associated with the start sequence at least immediately prior to a start signal synchronized with the start sequence of the racing event and during a drive phase of the racing event readable by a user regarding the form of the individual wherein detection of the false start is detectable independent of a starting block that may be used by the individual.

2. The system according to claim 1, further comprises a start race device and a computing device and wherein the start sequence comprises a plurality of phases and the at least one sensor includes an adjustable sensitivity configured to be adjusted during the plurality of phases of the start sequence.

3. The system according to claim 2, wherein the start race device comprises at least one of a speaker and a light illumination device for use to identify a start or the start signal of the racing event.

4. The system according to claim 2, wherein the start race device and computing device are in communication to provide start information to the computing device.

5. The system according to claim 1, wherein the detection subsystem further includes a strobe sensor device.

6. The system according to claim 5, wherein the strobe sensor device comprises the false start indicator wherein the false start indicator comprises a strobe light indicator to activate when a false start is detected.

7. The system according to claim 5, wherein the at least one sensor comprises at least one passive sensor to capture the biomechanical data about the individual.

8. The system according to claim 7, wherein the at least one passive sensor detects an abrupt change in temperature at a location by monitoring infrared radiation at the location to determine whether a false start occurs.

9. The system according to claim 2, wherein the at least one sensor comprises at least one passive sensor with a communication subsystem to communicate wirelessly with the computing device.

10. The system according to claim 2, further comprising at least one imaging device located behind a backside and starting location of the individual in the racing event to acquire biomechanical data from the individual to provide performance metrics.

11. The system according to claim 1, wherein the detection subsystem comprises at least one of a speaker and at least one microphone.

12. The system according to claim 11, wherein the at least one speaker provides at least one an audible start signal and instruction from a user that has access to the performance metrics.

13. A system comprising:

a computing device configured to execute a start sequence having a plurality of phases;

a start race device in communication with a computing device, the computing device and start race device are located at a location were initiation of a race event occurs;

a strobe sensor device located behind an individual about to start the race event independent of a starting block;

wherein in combination the start race device and strobe sensor device detects during the start sequence a false start to the race event by the individual independent of a sensor as part of a starting block; and wherein the strobe sensor device acquires biomechanical data specific to a form from a backside of the individual at least immediately prior to a start signal synchronized with the start sequence of a race event associated with the start sequence and during a drive phase of the race event, the biomechanical data is wirelessly communicated to the computing device to provide performance metrics to a user of the computing device and the strobe sensor device includes a false start indicator.

14. The system according to claim 13, wherein the start race device comprises at least one of a speaker and a light flash device to initiate a start to the race event.

15. The system according to claim 13, further comprising structure equipment to secure the strobe sensor device.

16. The system according to claim 13, wherein the structure equipment comprises at least one retractable traffic cone.

17. The system according to claim 13, wherein the strobe sensor device comprises at least one passive sensor in communication with the computing device.

18. The system according to claim 17, wherein the at least one passive sensor detects an abrupt change in temperature at a location by monitoring infrared radiation at the location.

19. The system according to claim 17, wherein the at least one passive sensor further comprises at least one reversible orientation mirror to narrow a field of view of the at least passive sensor.

20. The system according to claim 13, wherein the strobe sensor device comprises at least one imaging device with the at least one imaging device located behind a starting location of the individual in the racing event to acquire biomechanical data from the individual to provide performance metrics.

* * * * *